United States Patent [19]

Trudell

[11] 4,220,366

[45] Sep. 2, 1980

[54] LIFTER FOR VALVE-BOXES

[76] Inventor: William R. Trudell, 7173 Quincey La., Clearwater, Fla. 33516

[21] Appl. No.: 31,832

[22] Filed: Apr. 20, 1979

[51] Int. Cl.[3] ..... B25B 7/00

[52] U.S. Cl. ..... 294/104; 294/28

[58] Field of Search ..... 294/104, 106, 173, 87.2, 294/87.22, 87.24, 87.26, 87.28, 28, 31 R, 27 R, 32; 224/45 P, 56

[56] References Cited

U.S. PATENT DOCUMENTS

| | | | |
|---|---|---|---|
| 698,616 | 4/1902 | Zwerner | 294/28 |
| 1,147,316 | 7/1915 | Evans | 294/28 |
| 1,212,822 | 1/1917 | Schlepp | 294/28 |
| 1,330,487 | 2/1920 | Mullen | 294/31 R |
| 1,563,600 | 12/1925 | Walton | 294/86.14 |
| 1,716,849 | 5/1929 | Culp | 294/32 |

*Primary Examiner*—James B. Marbert

*Attorney, Agent, or Firm*—William A. Newton

[57] ABSTRACT

There is disclosed a lifting device for removing valve-boxes and sections thereof wherein a pair of pivoted, opposed side frames are pivoted about a pair of linking bars to securely grip the valve-box. The lifting device further includes a pair of adjustable locking hinges to provide more tension for a more secure grip about the valve-box, whereby the valve-box can subsequently be removed from the ground in which it was previously implanted.

7 Claims, 2 Drawing Figures

LIFTER FOR VALVE-BOXES

FIELD OF THE INVENTION

The present invention relates to lifting devices for removing valve-boxes.

DESCRIPTION OF THE PRIOR ART

In water, gas and sewer utilities and like utilities, such as those existing in municipalities, the valves for underground pipes are typically positioned at the bottom of valve-boxes, such valve-boxes normally having sections. Hence, access to the valves can be accomplished through the valve-boxes. These valve-box sections are removed when maintenance is required on the valves, or road construction necessitates adjustment, or daily adjustments are made due to ground conditions. Normally, these valve-boxes can be anywhere from 10 inches to 3 or 4 feet below the surface of the ground. The difficult process of removing the valve-boxes is now accomplished in the prior art by hand, using a shovel as a pry bar, or wrapping a chain around the top of the valve-box and trying to pull it out of the ground. The prior art is best exemplified by U.S. Pat. No. 698,616 to Zwerner, U.S. Pat. No. 1,147,316 to Evans, U.S. Pat. No. 1,330,487 to Mullen, U.S. Pat. No. 1,563,600 to Walton, and U.S. Pat. No. 1,716,849 to Culp.

Accordingly, it can be readily seen that there is a need in utility industries for a device to remove valve-boxes and sections thereof, such device needing to be simple, inexpensive to manufacture and maintain, being sufficiently durable ffor continued use under adverse conditions and structured to be sufficiently strong, while being relatively light in weight.

SUMMARY OF THE INVENTION

The present invention relates to a lifting device for removing a valve-box and sections thereof from the ground. The lifting device comprises a pair of opposed, elongated side frames which are pivotally interconnected by a pair of linking bars. Each of the side frames terminate in an outward bowed bar so as to define a gripping jaw. The lifting device is spread apart at the top, so that the gripping jaw grasps the valve-box. A pair of adjustable locking hinges are set to produce more tension to provide a secure grip of the gripping jaw about the valve-box, thereby enabling easier lifting.

BRIEF DESCRIPTION OF THE DRAWINGS

Further objects and advantages of the present invention will become apparent as the following description proceeds, taken in conjunction with the accompanying drawings in which.

DESCRIPTION OF THE PREFERRED EMBODIMENT

Figure 1:
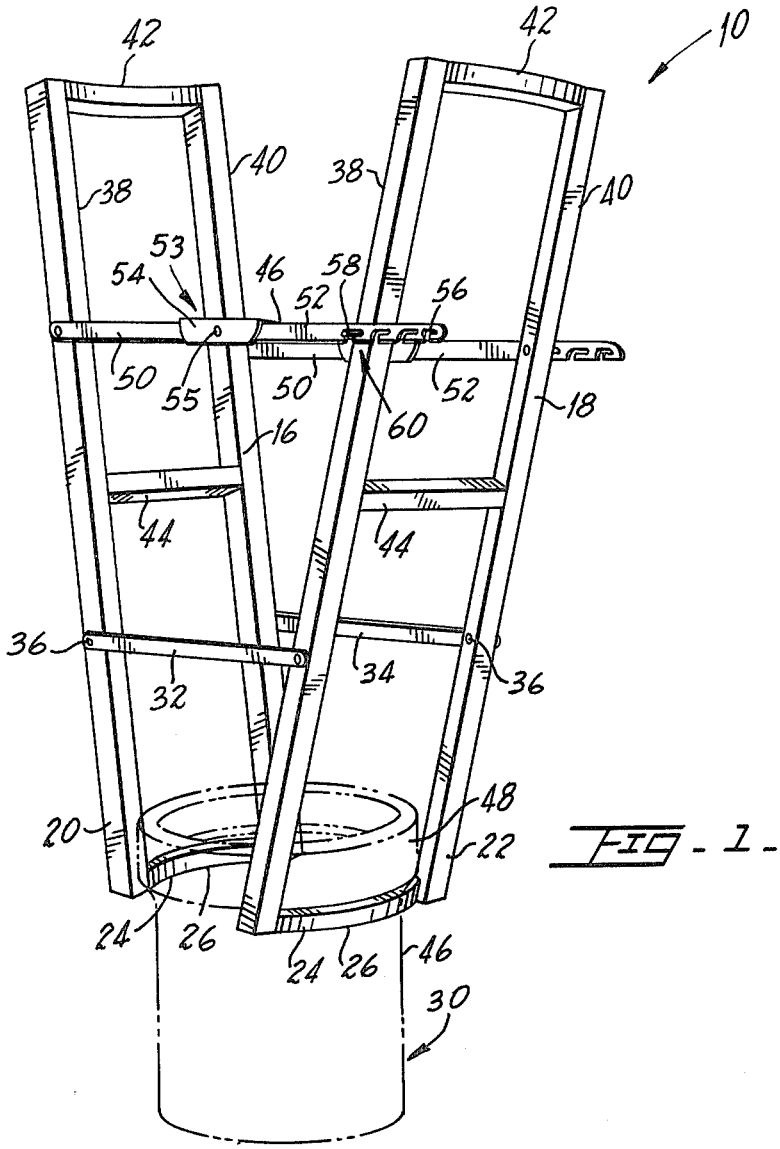
FIG. 1 is a perspective view of the preferred embodiment of the lifting device of the present invention.

A lifting device, generally indicated by numeral 10, is disclosed for lifting and removing valve-box top section 12 and valve-box bottom section 14, as illustrated in FIG. 1. The lifting device 10 comprises a pair of opposed side frames 16 and 18 which are adapted for pivoting toward each other at their lower portions 20 and 22 respectively, so as to define a segmented yoke or gripping jaw 24. More specifically, each of the lower ends of the side frames 16 and 18 terminate in mirror image outward bowed bars 26, each of which are configured and dimensioned to clamp about a valve-box 30.

Referring to FIG. 1, the pair of side frames 16 and 18 are pivotally connected to each other by a pair of linking bars 32 and 34. Each of the linking bars 32 and 34 are connected at opposed ends to one of the side frames 16 and 18 by pivotal pins 36. The side frames 16 and 18 each include a pair of longitudinal side bars 38 and 40, which are rigidly connected by an upper handle transverse bar 42, a center handle transverse bar 44 and the outer bowed bar 26.

Preferably above the center of the side frames 16 and 18, a pair of adjustable locking hinges 46 and 48 are each pivotally attached at opposed ends to the side frames 16 and 18. Each of the locking hinges 46 and 48 comprises a pair of foldable arms 50 and 52 which are pivotally connected at a centrally positioned joint 54. The joint 53 preferably includes a joint sleeve 54, which is rigidly attached to one end of one of the foldable arms 50 and which encases the end of the other corresponding foldable arm 52. A pin 55 traverses the joint sleeve 54 and the encased foldable arm 52 so as to pivotally connect the two. On the end of each foldable arm 52, there is provided a plurality of longitudinally aligned, spaced apart groves 56. The groves 56 have a curvilinear configuration and are dimensioned and aligned to receive a protruding pin 58, mounted in fixed relationship in the side bars 38 and 40 of the side frame 18. The pin 58 and the groves 56 define a latch arrangement 60 which, although shown to be adjacent the side frame 18, could be adjacent the side frame 16. Also, the joint sleeve 54 could be rigidly connected to either of the foldable arms 50 and 52. Preferably, the lifting device 10 is formed of a hollow, square metal tubing, such as aluminum, with each of its joints being welded in a conventional manner.

As is illustrated in FIG. 1, the lifting device 10 is used to easily and safely remove valve-boxes 30. In operation, the foldable arms 46 and 48 are initially in a folded position so that the gripping jaw 24 has its opposed outward bowed bars 26 spread apart a sufficient distance to receive one end of the valve-box 30, either the bottom section 14 or top section 12, or some section interposed therebetween (not shown). Next, the lower portion of the lifting device 10 is placed over the valve-box 30 so that the segmented jaw 24 of the same surrounds the valve-box 30. At this point, the adjustable locking hinges 46 and 48 are folded upward in a V-shaped disposition, with the pin 58 in a preferably preselected groove 56. The locking hinges 46 and 48 are then clamped down in their lock position with the corresponding foldable arms 50 and 52 being linearly aligned. The diverging movement of the upper portion of the lifting device 10 tightens the grasp of the segmented jaw 24 about the valve-box 30. The degree of tightness is a function of the selection of the grooves 56. In other words, the locking hinges 46 and 48 produce more tension for a more secure grip about the valve-box 30, enabling easier lifting. Locking hinges 46 and 48 can be released from their locking relationship so that further adjustment can be undertaken to obtain the desired groove 56. It should also be appreciated that an additional force can be manually applied between the two side frames 16 and 18 so as to spread the handle bars 42 apart a sufficient distance to allow the hinges 46 and 48 to lock. After the lifting device is locked into position, preferably two users position themselves on the outer side of each of the side frames 16 and 18. Then each user grasps the transverse bars 42 and/or 44 with his hands, and pulls upward. This allows for the valve-box 30 or section thereof to be readily removed.

Figure 2:
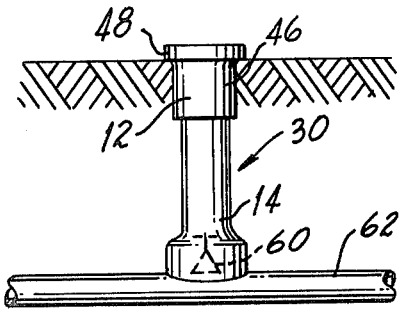
FIG. 2 is a view of the environment in which the present invention is to be used.

Referring to FIG. 2, generally the valve-box 30, typically found in existing utility supply systems, comprises a plurality of sections, such as bottom valve-box section 14 and top valve-box section 12. With the top valve section 12, a relatively loose grip can be maintained about a neck portion 46, due to a flange portion 48 having a larger diameter. In removing the bottom valve section 14, a relatively tight grip on the bottom valve portion 14 must be achieved by adjusting the locking hinges 46 and 48, in that there is no upper flared portion to the bottom valve-box section 14. The valve-box 30 is used to obtain access to a valve 60 of underground pipe 62, which can be a sewer, water, gas or like pipe.

Referring to FIG. 1, although not preferred, the lifting device 10 could be modified to have only one locking hinge 46 or 48 and only one linking bar 32 or 34. In such a variation, the locking hinge and linking bar would be preferrably centrally disposed between the side bars 38 and 40.

Although particular embodiments of the invention have been shown and described here, there is no intention to thereby limit the invention to the details of such embodiments. On the contrary, the intention is to cover all modifications, alternatives, embodiments, usages and equivalents of the subject invention as fall within the spirit and scope of the invention, specification and the appended claims.

What is claimed is:

1. A lifting device for removing valve-boxes from the ground, said lifting device comprising:

a pair of side frames;

said side frames each having an end portion cooperatively aligned to define a segmented gripping jaw;

at least one foldable locking hinge, said locking hinge being pivotally attached at each end to one of said side frames;

at least one linking bar, said linking bar being pivotally attached at each end to one of said side frames, said linking bar being pivotally attached to said side frames at a position intermediate to said foldable locking hinge and said gripping jaw.

2. In the lifting device of claim 1, said foldable locking hinge comprising an adjustable locking hinge for varying the distance between said end portions which define said gripping jaw.

3. In the lifting device of claim 2, said adjustable locking hinge including a plurality of longitudinally disposed grooves;

said adjustable locking hinge further including a pin mounted in one of said side frames and disposed for latching interconnection with one of said grooves.

4. In the lifting device of claim 3, said adjustable locking hinge comprising a pair of foldable arms, each said foldable arm being pivotally connected at one end to the other said foldable arm and at the other end to one of said side frames.

5. In the lifting device of claim 4, said at least one foldable locking hinge comprising a pair of foldable locking hinges disposed on opposed sides of said side frames.

6. In the lifting device of claim 5, said at least one linking bar comprising a pair of linking bars disposed on opposed sides of said side frames.

7. In the lifting device of claim 6, said end portions defining said gripping jaw each comprising an outward bowed bar.

* * * * *